US005480133A

United States Patent [19]

Motev et al.

[11] Patent Number: 5,480,133

[45] Date of Patent: Jan. 2, 1996

[54] ADJUSTABLE SHEET TAKE-OFF MECHANISM FOR A SCREEN PRINTING PRESS

[75] Inventors: Phil Motev, Deerfield; Simon Kitaygorodskiy, Chicago, both of Ill.

[73] Assignee: A.W.T. World Trade, Inc., Chicago, Ill.

[21] Appl. No.: 238,373

[22] Filed: May 5, 1994

[51] Int. Cl.[6] ..... B65H 29/10

[52] U.S. Cl. ..... 271/85; 101/114; 198/468.2; 271/265.02; 271/268

[58] Field of Search ..... 271/84, 85, 265.01, 271/265.02, 267, 204, 206, 277, 82, 268; 101/114, 123, 124; 198/468.2, 468.9; 414/792.9, 794.7

[56] References Cited

U.S. PATENT DOCUMENTS

| | | | |
|---|---|---|---|
| 3,860,231 | 1/1975 | Oltra | 271/85 |
| 3,891,204 | 6/1975 | Mager | 271/85 |
| 4,031,824 | 6/1977 | Bubley et al. | 101/126 |
| 4,058,307 | 11/1977 | Bubley et al. | 271/85 |
| 4,284,301 | 8/1981 | Geiger et al. | 271/268 X |
| 4,460,083 | 7/1984 | Oyama | 271/85 X |
| 4,512,563 | 4/1985 | Bubley | 271/85 |
| 4,588,070 | 5/1986 | Smith | 271/268 X |
| 4,615,288 | 10/1986 | Matsuda | 198/468.2 X |
| 4,879,948 | 11/1989 | Bubley | 101/114 |

*Primary Examiner*—James R. Bidwell
*Assistant Examiner*—Carol L. Druzbick
*Attorney, Agent, or Firm*—Silverman, Cass & Singer, Ltd.

[57] ABSTRACT

The invention is a take-off apparatus for removing sheets of stock from the bed of a screen printing press where the apparatus accommodates variations in the shape, position and size of the stock and includes a carriage member slidably mounted to a take-off frame which travels from a pick-up point through a drop-off point, and adjustable gripper bars mounted to the carriage member for gripping the stock at the pick-up point and for releasing the stock at the drop-off point. To accommodate variable arrangements of the forward edge, each gripper bar of the invention is adjustable on the carriage member laterally for selective positioning of the gripper bars along and longitudinally for selective positioning of the gripper bars at a forward edge of the stock.

24 Claims, 2 Drawing Sheets

FIG. 1
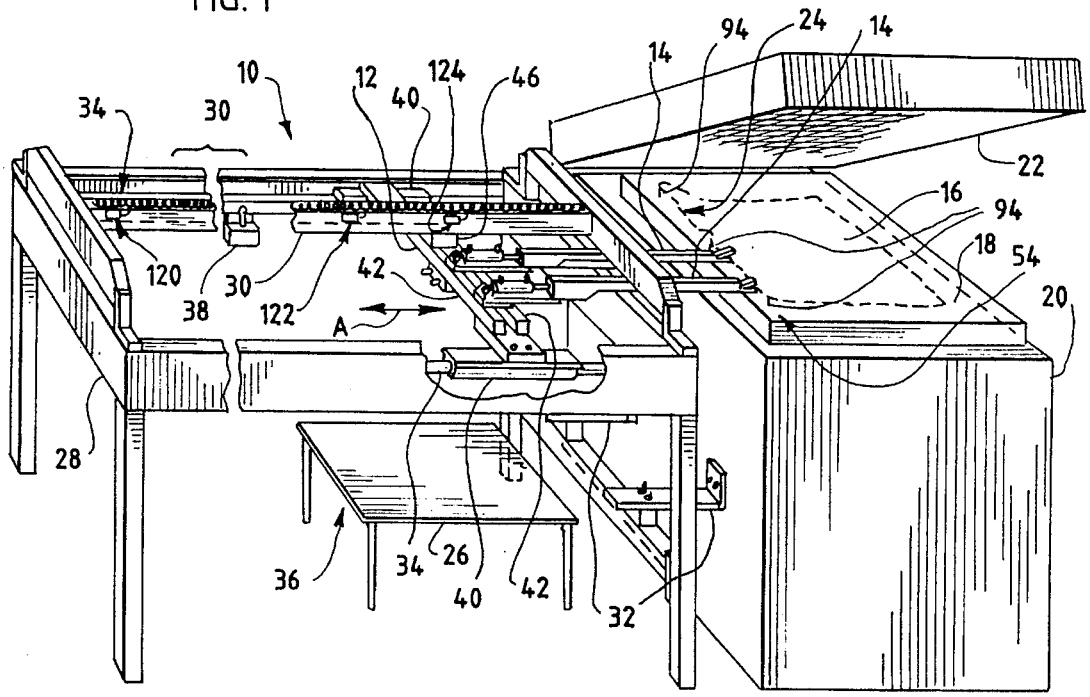
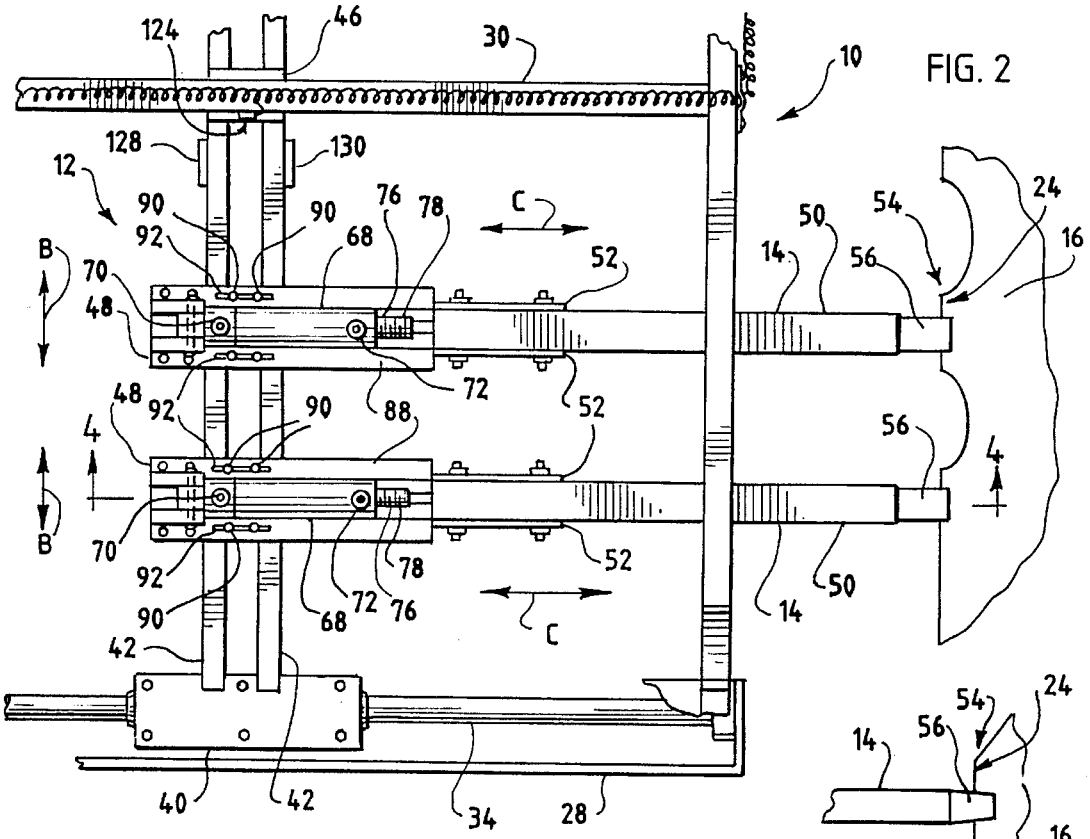
FIG. 2
FIG. 3

ADJUSTABLE SHEET TAKE-OFF MECHANISM FOR A SCREEN PRINTING PRESS

FIELD OF THE INVENTION

This invention relates generally to take-off mechanisms for screen printing presses and more particularly, relates to a take-off mechanism having one or more adjustable gripper bars mounted on a reciprocating carriage assembly for removing stock from a printing press where each gripper bar is adjustable laterally along the stock and longitudinally toward and away from the stock to readily accommodate variations in the shape, position and size of the stock.

BACKGROUND OF THE INVENTION

Take-off mechanisms are utilized to remove a sheet of stock from a press bed of a silk screen printing press or the like after each press cycle. These take-off mechanisms generally include grippers mounted on a reciprocating carriage which serve to remove printed stock by gripping the stock as the carriage moves adjacent the printing press and thereafter releasing the stock onto a drying bed or rack as the carriage travels a desired distance away from the printing press. Typically, the grippers are fixed in position on a traverse shaft or similar support member of the carriage and are actuated by engaging a ramp, dog or other similar structure on the take-off frame. To expose a leading edge of the stock to facilitate removal, the take-off mechanisms may operate in communication with drop edge mechanisms and lift members on the press which are mechanically linked to the take-off frame or in cooperation with cutouts on the press bed.

An example of one such assembly is illustrated in U.S. Pat. No. 4,512,563which discloses a take-off apparatus having a carriage with a plurality of grippers mounted on a common transverse shaft where the gripper jaws of the grippers are opened in unison by rotation of the transverse shaft. The shaft rotates by engaging a ramp mounted to the take-off frame. To assist in the pick-up and removal of a printed sheet of stock from the printing press, a leading edge of the printed sheet is raised by a plurality of pins driven upward by a pin drive mechanism. The pin drive mechanism is mechanically linked to the take-off and is actuated by the approaching carriage.

Such an assembly, however, does not permit adjusting the position of each of the gripper bars either laterally or longitudinally to provide for ready removal of irregularly shaped sheets. Further, the assembly does not provide for selectively controlling the take-off carriage and the pin drive mechanism independently one from the other.

It therefore would be desirable to provide adjustable gripper bars on the carriage where each may be independently repositioned laterally or longitudinally to readily accommodate variations in the shape, position, and size of the stock. It also would be desirable to provide grippers with adjustably spaced jaws for removing stock with varying thicknesses. To provide for manual stock removal and selective operation of the take-off, it would further be desirable to control the operation of the take-off carriage and grippers independently of the printing press and lift pins. In addition, it would be desirable for the carriage to be moved at a high speed after the gripper jaws have gripped the forward edge of the printed stock to the position for release of the printed stock and to move slowly toward the lifted forward edge of the printed stock for gripping the lifted edge.

SUMMARY OF THE INVENTION

The invention is a take-off apparatus for removing sheets of stock from a bed of a screen printing press wherein the apparatus has adjustable gripper bars which readily accommodate variations in the shape, position and size of the stock. The apparatus includes a carriage assembly slidably mounted to a take-off frame which travels from a pick-up point through a drop-off point, and one or more gripper bars mounted to the carriage assembly for gripping a forward edge of the stock at the pick-up point and for releasing the sheet as the carriage assembly travels through the drop-off point. The carriage assembly is returned rapidly to its pick-up position in proximity to the press bed as the printing press completes a subsequent printing. When the printing cycle is completed, the carriage is moved forwardly at a slow speed to enable the gripper jaws to grip the forward edge of the stock sheet which has been lifted by the lift pins on the press. To accommodate variable arrangements of the forward edge, the position of each gripper bar is adjustable on the carriage assembly both laterally for selective positioning of a pair of gripper jaws along, and longitudinally for selective positioning of the gripper jaws at the forward edge of the stock.

BRIEF DESCRIPTION OF THE DRAWINGS

FIG. 1 is a front pictorial view, partially removed, of a take-off mechanism of the invention illustrated adjacent to a screen printing press and overlying a drying apparatus;

FIG. 2 is an enlarged top view, in partial section, illustrating two gripper bars mounted on a carriage assembly and positioned in preparation for gripping an irregular front edge of the stock;

FIG. 3 is an enlarged top view, in partial section, illustrating one gripper bar positioned in preparation for gripping an alternative arrangement of the front edge of the stock;

DESCRIPTION OF THE PREFERRED EMBODIMENTS

Figure 6:
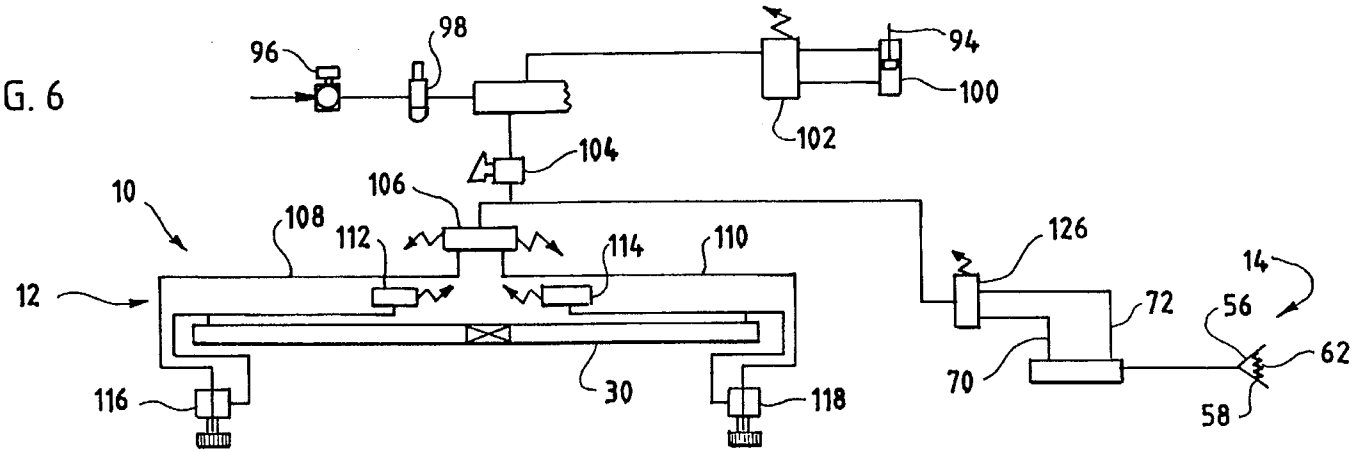
FIG. 6 is a schematic view of a pneumatic system for a carriage drive cylinder, a gripper drive cylinder, and a pin lift mechanism.

Referring to FIG. 1, the adjustable stock take-off mechanism of the invention generally is designated by the reference numeral 10. The mechanism 10 includes a slidable carriage assembly 12 and at least one gripper bar 14 mounted thereto.

Briefly, in operation, the take-off mechanism 10 is typically utilized to remove a sheet of stock 16, as illustrated in phantom outline, from a press bed 18 of a screen printing press 20 after a press cycle has been completed. To permit removal of the stock 16, a printing head 22 pivots upwardly to expose a forward edge 24 of the stock 16. The carriage assembly 12 of the invention travels to a position adjacent to the printing press 20 to locate the gripper bars 14 at the forward edge 24 of the stock 16 for gripping the stock 16 and then, retracts from the printing press 20, thereby removing the stock 16 for release onto a drying rack or belt 26. The direction of reciprocating travel of the carriage assembly 12 is indicated by arrow "A".

In order to accommodate stock 16 having variations in shape, size or position, the gripper bars 14 of the invention are adjustable on the carriage assembly 12. As illustrated in FIG. 2, each of the gripper bars 14 are independently adjustable laterally in the direction of arrows "B" and longitudinally in the direction of arrows "C" to accommodate an irregular shape of the stock 16.

As illustrated in FIG. 1, the take-off mechanism 10 of the invention includes a take-off frame 28 preferably positioned transverse to the printing press 20. The position of the take-off mechanism 10, however, may be varied so long as the gripper bars 14 can be positioned to grip and remove the stock 16.

The take-off frame 28 includes a pneumatic carriage drive cylinder 30 mounted longitudinally on the take-off frame 28 for actuating the carriage assembly 12 as will be discussed more fully hereinafter. To maintain alignment of the take-off mechanism 10 with respect to the printing press 20, it is desirable to secure the take-off frame 28 to the printing press 20 by attachment brackets 32 bolted thereto.

To provide a track for the carriage assembly 12 to slide along, the take-off frame 28 further includes carriage rails 34 extending longitudinally and secured at their ends to the take-off frame 28 as illustrated in FIGS. 1 and 2. The carriage rails 34 preferably are tubular.

To trigger the release of the stock 16 onto the drying rack 26 at a drop-off point generally indicated by reference numeral 36, the take-off frame 28 preferably includes a trigger mechanism 38 positioned a selected distance away from the printing press 20 as illustrated in FIG. 1. The trigger mechanism 38 preferably is a lever actuated switch or other similar device which is tripped by the outward passage of the carriage assembly 12. To permit adjustment of the drop-off point 36, the trigger mechanism 38 is fastened to the take-off frame 28 by bolts or the like for ready repositioning.

The carriage assembly 12 is mounted on the take-off frame 28 by carriage guides 40 slidably engaged with each carriage rail 34. Traverse bars 42 are affixed to and extend between the carriage guides 40 as illustrated in FIGS. 1 and 2.

The slidable engagement of the carriage guides 40 with the carriage rails 34 permits the carriage assembly 12 to travel in the direction of arrow "A" seen in FIG. 1 for pick-up and removal of the stock 16. To provide reciprocating movement for the carriage assembly 12, the carriage assembly 12 is operably engaged to the carriage drive cylinder 30 by a bracket 46.

To grip and remove the stock 16 from the printing press 20, a plurality of the gripper bars 14, preferably three, are attached to the traverse bars 42 of the carriage assembly 12. It should be appreciated that a greater or lesser number of gripper bars 14 may be provided, as desired.

Figure 4:
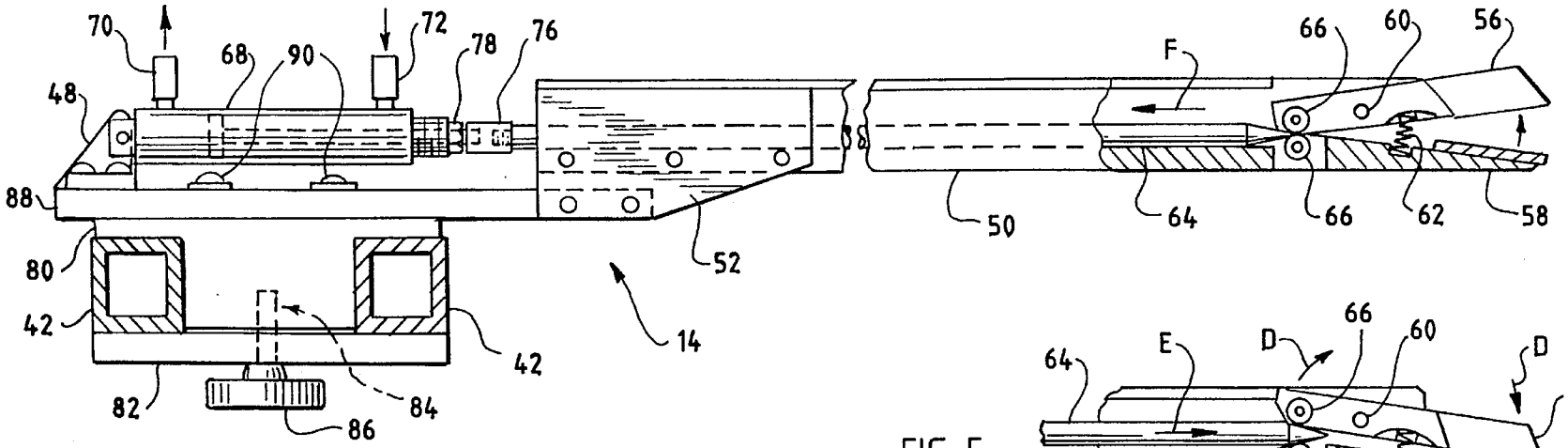
FIG. 4 is a side elevational view, in partial section, illustrating one of the gripper bars mounted on the carriage assembly with the gripper jaws in an open position as viewed in the direction of arrows 4 of FIG. 2.

The gripper bars 14 extend longitudinally from the carriage assembly 12 toward the printing press 20 as illustrated in FIG. 1. As seen in FIG. 4, each gripper bar 14 includes an upper assembly 48 and an arm 50 which is mounted to the upper assembly 48 by side brackets 52 and bolts or the like.

To grip the forward edge 24 of the stock 16 at a pickup point generally indicated in FIG. 2 by reference numeral 54, each gripper bar 14 is provided with upper and lower gripper jaws 56, 58 as illustrated in FIG. 4. The lower gripper jaw 58 preferably is fixed to the arm 50 and the upper gripper jaw 56 is pivotally mounted to the arm 50 by a pivot screw 60. A spring 62 is provided therebetween to bias the gripper jaws 56, 58 into an open position as illustrated in FIG. 4.

Figure 5:
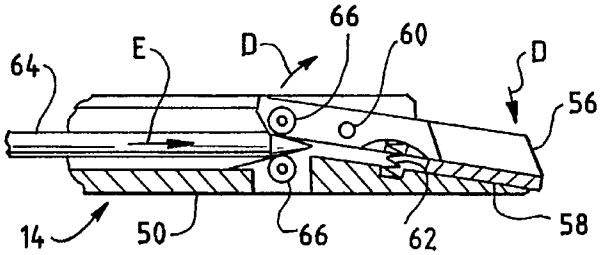
FIG. 5 is a side view, in partial section, illustrating the gripper jaws of one of the gripper bars with the gripper jaws in the closed position.

To pivot the upper gripper jaw 56 downwardly into a closed position as generally indicated by arrows "D" in FIG. 5, a follower 64 having a conical shape is slidably disposed within the arm 50 and is engaged between rollers 66. The follower 64 serves to pivot the upper gripper jaw 56 as the follower 64 moves in the direction of arrow "E" seen in FIG. 5. To selectively govern sliding of the follower 64 for opening and closing the gripper jaws 56, 58, the follower 64 is operably connected preferably to a gripper drive cylinder 68 as illustrated in FIG. 4.

The gripper drive cylinder 68 is pneumatic, and has an air line 70 for actuating the follower 64 in the direction of arrow "E" seen in FIG. 5 to close the gripper jaws 56, 58 and an air line 72 for reversing the follower 64 in the direction of arrow "F" seen in FIG. 4 to open the gripper jaws 56, 58. The gripper drive cylinder 68 is pivotally mounted at one end to the upper assembly 48, which permits vertical displacement of the follower 64 which may result during opening and closing of the gripper jaws 56, 58.

It may be desirable when printing and removing stock having varying thicknesses, such as masonite or aluminum, to provide a gripper gap (not illustrated) between the gripper jaws 56, 58 when rotated to their closed position. To vary the gap (not illustrated), a turnbuckle 76 and a lock nut 78 are included within the connection between the follower 64 and the gripper drive cylinder 68. By loosening the lock nut 78, the turnbuckle 76 may be rotated to adjust the amount of insertion of the follower 64 between the rollers 66 in the direction of arrow "E" seen in FIG. 5 and to thereby vary the gripper gap (not illustrated).

To mount the gripper bars 14 to the traverse bars 42, the upper assembly 48 is secured to a T-shaped upper clamping plate 80 which seats between the traverse bars 42 as seen in FIG. 4. A clamping force is provided by a lower clamping plate 82 which is positioned below the traverse bars 42 and attached to the upper clamping plate 80 by a bolt 84 and an attached knob 86.

The combination of the upper and lower clamping plates 80, 82 permits independent lateral adjustment of each gripper bar 14 along the traverse bars 42 in the direction indicated by arrows "B" seen in FIG. 2. To accommodate sheets of stock 16 having a variable arrangement as generally illustrated in FIGS. 2–4, the knob 86 can be loosened, the gripper bar 14 laterally adjusted along the traverse bar 42 and the knob 86 retightened to secure the gripper bar 14 in place.

In addition to being laterally adjustable, the gripper bars 14 are longitudinally adjustable in the direction indicated by arrows "C" seen in FIG. 2. To permit longitudinal adjustment, the upper assembly 48 has a slide plate 88 which is secured to the upper clamping plate 80 by bolts 90 as illustrated in FIGS. 2 and 4. Channels 92 are provided in each slide plate 88 which permits the gripper bars 14, as well as the pick-up point 54, to be longitudinally adjusted in the direction of arrows "C" upon loosening of the bolts 90.

It is noted that lateral adjustment may be accomplished without affecting the longitudinal position of the gripper bars 14 and vice versa. It is further noted that gripper bars 14 may be added or removed as desired since the lower clamping plate 82 is readily detachable.

To facilitate gripping of the stock 16 by the gripper bars 14, the printing press 20 preferably is provided with a plurality of lift pins 94 to raise the forward edge 24 of the stock 16 a predetermined distance above the press bed 18 as illustrated in FIG. 1. The lift pins 94 are retracted within the press bed 18 during the press cycle and are pneumatically actuated to extend above the press bed 18 for raising the forward edge 24. Preferably, the lift pins 94 are responsive to the press cycle and may operate independent of the activation or the presence of the takeoff mechanism 10. Such lift pin arrangements are known in the art of silk screen presses.

In the preferred embodiment of the invention, the carriage assembly 12, the gripper bars 14 and the lift pins 94 are independently actuated by a pneumatic system generally illustrated by the schematic diagram of FIG. 6. It is recognized that alternative control methods may be incorporated, such as electric motors or the like, so long as the desired operation of the invention as disclosed herein is achieved.

Typically, standard industrial air lines (not illustrated) are utilized which preferably supply air up to 100 psi (7.03 $kg/cm^2$) at 1 cfm (0.02832 $m^3$/min.) and which pass through an air filter and pressure gauge assembly 96 and an oiler 98. To control a lift pin cylinder 100 to actuate the lift pins 94, an electrically actuated valve 102 is provided which is responsive to the press cycle of the printing press 20.

To selectively activate or deactivate the take-off mechanism 10, an on-off switch 104 is provided. Activating the switch 104 provides air to the carriage assembly 12 and the gripper bars 14.

Reciprocating motion of the carriage drive cylinder 30 and attached carriage assembly 12 is controlled by an electrically actuated valve 106 which pressurizes either an air line 108 to move the carriage assembly 12 through a pick-up stroke or an air line 110 to move the carriage assembly 12 through a drop-off stroke. Air lines 108, 110 are provided with electrically actuated pressure release valves 112, 114 respectively.

To independently adjust the speed of the pick-up stroke, the air line 108 is provided with a flow control valve 116. To similarly adjust the speed of the drop-off stroke, the air line 110 is provided with a flow control valve 118. Each flow control valve 116, 118 may be adjusted independently one of the other to coordinate the take-off mechanism 10 with the operation of the printing press 20 (not illustrated in FIG. 6).

To control the operation of the valve 106 and the reciprocating motion of the carriage assembly 12, three sensors 120, 122, 124 are mounted along the carriage drive cylinder 30 as illustrated in FIG. 1. One skilled in the art would recognize these sensors 120, 122, 124 may be of any type so long as they are tripped by the carriage assembly 12, operably communicate with the valve 106, and serve the purposes described herein.

The sensor 120 is provided to sense the position of the carriage assembly 12 in order to reverse its direction from the drop-off stroke to the pick-up stroke. The sensor 122 is provided to detect and stop the carriage assembly 12 at its rest position when the take-off mechanism 10 is not in operation. The sensor 124 is provided to sense the position of the carriage assembly 12 in order to reverse its direction to travel through the drop-off stroke after passing through the pick-up stroke and reaching the pick-up point 48 of the gripper bars 14.

Referring to the operation of the gripper bars 14, an electrically actuated valve 126 is provided as illustrated in FIG. 6 to control the operation of each gripper drive cylinder 68. The valve 126 serves to pressurize either the air line 70 to close the gripper jaws 56, 58 or the air line 72 to open the gripper jaws 56, 58.

The valve 126 is actuated by the sensor 124 illustrated in FIG. 1 to close the gripper jaws 56, 58 at the pick-up point 54. The valve 126 is similarly actuated by the trigger mechanism 38 to open the gripper jaws 56, 58 at the drop-off point 36.

To operate the gripper bars 14 in unison for gripping the stock 16, the air lines 70 of the gripper bars 14 preferably connect at a single manifold 128 as illustrated in FIGS. 1 and 2 which then connects to the valve 126 seen in FIG. 6. Air lines 72 of the gripper bars 14 would also connect at a manifold 130 as illustrated in FIG. 2 to operate the gripper bars 14 in unison for release of the stock 16.

In operation, the gripper bars 14 are laterally and longitudinally adjusted depending upon the shape, position and size of the particular stock 16 being printed. For example, irregular sheets of stock 16 may have to be accommodated as generally illustrated by FIGS. 2 and 3.

Each gripper bar 14 is laterally adjusted in the direction of arrows "B" as FIG. 2 illustrates by loosening the knob 86 illustrated in FIG. 4. The clamping force provided by the upper and lower clamping plates 80, 82 is removed and the position of the gripper bars 14 is selectively adjusted along the traverse bars 42. Once laterally adjusted, the knob 86 is retightened.

Each gripper bar 14 also may be longitudinally adjusted as desired in the direction of arrows "C" seen in FIG. 2 to set the pick-up point 54 of the gripper bars 14. Adjustment is accomplished by loosening the bolts 90 on the particular gripper bar 14 being adjusted, and then adjusting the gripper bar 14 before retightening the bolts 90.

Referring to FIG. 2, to accommodate stock 16 having different thicknesses, the gripper gap (not illustrated) between the gripper jaws 56, 58 may be increased. The gripper gap (not illustrated) is set by loosening the lock nut 78 and then turning the turnbuckle 76 accordingly to adjust the position of the follower 64.

The drop-off point 36 may also be adjusted to accommodate variations in the type of stock 16 or to adapt the take-off mechanism 10 to a different drying rack or belt 26 as seen in FIG. 1. The drop-off point 36 is set by selectively positioning the trigger mechanism 38 along the take-off frame 28.

During a typical printing operation, the printing head 22 of the printing press 20 would be lowered onto the stock 16, print the stock 16 and then be pivoted upwardly to expose the forward edge 24 of the stock 16. In response to the completion of the press cycle, the lift pins 94 would be actuated to extend upwardly and lift the forward edge 24 from the press bed 18.

During this printing cycle, the carriage assembly 12 is moved rapidly from the position of sensor 120 along the direction of arrow "A" until reaching the position of sensor 122 at the rest position. The carriage assembly 12 then is moved slowly to position the gripper jaws 56, 58 at the pick-up point 54 at the forward edge 24 of the stock 16 as seen in FIG. 2. The carriage assembly 12 is moved at a reduced gripping speed to reach the pick-up point 54 as the lift pins 94 elevate to finish lifting the forward edge 24.

Upon reaching the pick-up point 54, the gripper drive cylinder 68 is operated to close the gripper jaws 56, 58 as illustrated in FIG. 5 while the carriage assembly 12 reverses direction to travel through the drop-off stroke. Preferably, the carriage assembly 12 travels at maximum speed between the sensor 124 and the trigger mechanism 38 seen in FIG. 1.

Once the carriage assembly 12 passes through the drop-off point 36 and trips the trigger mechanism 38 illustrated in FIG. 1, the gripper drive cylinder 68 again, operates to open the gripper jaws 56, 58 to release the stock 16 onto the drying rack 26. Thereafter, the carriage assembly 12 is reduced in speed and continues slowly through the drop-off stroke until activating the sensor 120. Upon activating the sensor/20, the carriage assembly 12 reverses direction to again travel at maximum speed through the pick-up stroke to the rest position. The take-off mechanism 10 preferably reciprocates in this manner in conjunction with the operation of the printing press 20.

To coordinate the operation of the take-off mechanism 10 with variations in the printing cycle of the printing press 20, the maximum pick-up speed and drop-off speed of the carriage assembly 12 are independently controlled by the flow control valves 116, 118. By varying the maximum pick-up speed and drop-off speed, the cycle of the take-off mechanism 10 can be adjusted to correspond with the press cycle as desired.

Modifications and variations in individual structures embodied in the present invention may occur to the skilled artisan in the light of the specification hereof without departing from the scope and spirit of the appended claims.

We claim:

1. A take-off apparatus for removing sheets of stock from a bed of a screen printing press comprising:

a take-off frame adapted to be operated adjacent said press;

a carriage member slidably mounted to said take-off frame and reciprocal through a pick-up stroke and a drop-off stroke for transferring said stock from said press; and at least one gripper assembly mounted to said carriage member for gripping a forward edge of said stock at a pick-up point as said carriage member travels through said pick-up stroke and for releasing said stock near a drop-off point as said carriage member travels through said drop-off stroke, said at least one gripper assembly including lateral adjustment means for selective positioning of said gripper assembly along said forward edge and longitudinal adjustment means for selective positioning of said gripper assembly at said forward edge of said stock to accommodate variable arrangements of said forward edge.

2. The apparatus as defined in claim 1 wherein said carriage member is operably connected with carriage drive means for selectively actuating said carriage member independently of said printing press, said carriage drive means including independent control means for selectively varying said pick-up stroke and said drop-off stroke of said carriage member to selectively coordinate said take-off apparatus with said printing press.

3. The apparatus as defined in claim 2 which includes sensing means actuated by said carriage member in a rest position and operably communicating with said carriage drive means for triggering said carriage drive means to actuate said carriage member at a reduced gripping speed as said carriage member travels between said rest position and said pick-up point, at an increased drop-off speed as said carriage member travels through said drop-off stroke from said pick-up point to said drop-off point and at an increased pick-up speed as said carriage member travels through said pick-up stroke to said rest position, said independent control means including a pick-up speed control and a drop-off speed control.

4. The apparatus as defined in claim 1 wherein said gripper assembly includes gripper drive means operably engaged therewith for actuating said gripper assembly to grip and release said stock.

5. The apparatus as defined in claim 4 wherein said gripper drive means is a pressure driven cylinder.

6. The apparatus as defined in claim 4 wherein said gripper assembly includes gripper jaws actuated by said gripper drive means to close said gripper jaws at said pick-up point and to open said gripper jaws in proximity to said drop-off point.

7. The apparatus as defined in claim 6 wherein said gripper drive means further comprise an adjustment mechanism for varying a gap between said gripper jaws to accommodate varying thicknesses of said stock.

8. The apparatus as defined in claim 1 which includes a plurality of said gripper assemblies, each of said gripper assemblies being adjustable both laterally and longitudinally independently one from the other on said carriage member.

9. A take-off apparatus for removing sheets of stock from a bed of a screen printing press comprising:

a take-off frame adapted to be operated adjacent said press;

a carriage member slidably mounted on said take-off frame and movable through a pick-up stroke and a drop-off stroke for transferring said stock from said press, carriage drive means operably connected to said carriage member for selectively actuating movement of said carriage member independently of said printing press, said carriage drive means including independent control means for selectively varying said pick-up stroke and said drop-off stroke of said carriage member to selectively coordinate said take-off apparatus with said printing press; and at least one gripper assembly mounted to said carriage member for gripping a forward edge of said stock as said carriage member travels through said pick-up stroke and for releasing said stock as said carriage member moves through said drop-off stroke, said at least one gripper assembly being adjustable on said carriage member including lateral adjustment means for selectively positioning said gripper assembly along said forward edge and longitudinal adjustment means for selectively positioning said gripper assembly at said forward edge of said stock to accommodate variable arrangements of said forward edge.

10. The apparatus as defined in claim 9 wherein said gripper assembly includes gripper drive means operably engaged therewith and movable with said gripper assembly for actuating said gripper assembly at predetermined points during said pick-up stroke and said drop-off stroke to grip and release said stock.

11. The apparatus as defined in claim 10 which includes trigger means mounted at a predetermined position on said take-off frame and operably communicating with said gripper drive means for actuating said gripper assembly to release said stock at a drop-off point as said carriage member passes through said drop-off stroke, said position of said trigger means being adjustable to vary said drop-off point of said stock.

12. The apparatus as defined in claim 9 which includes a plurality of gripper assemblies, each gripper assembly being adjustable both laterally and longitudinally independently one from the other on said carriage member.

13. The apparatus as defined in claim 9 which includes sensing means actuated by said carriage member in a rest position and operably communicating with said carriage drive means for triggering said carriage drive means to actuate said carriage member at a reduced gripping speed as said carriage member travels between said rest position and a pick-up point, at an increased drop-off speed as said carriage member travels through said drop-off stroke from said pick-up point to a drop-off point and at an increased pick-up speed as said carriage member travels through said pick-up stroke to said rest position, said independent control means including a pick-up speed control and a drop-off speed control.

14. A take-off apparatus for removing sheets of stock from a bed of a screen printing press comprising:

a take-off frame adapted to be operated adjacent said press;

a carriage member slidably mounted on said take-off frame and reciprocal through a pick-up stroke and a drop-off stroke for transferring said stock from said press, carriage drive means operably connected to said carriage member for selectively actuating movement of said carriage member independently of said printing press; and at least one gripper assembly mounted to said carriage member having gripper jaws for gripping a forward edge of said stock as said carriage member travels through said pick-up stroke and for releasing said stock as said carriage member moves through said drop-off stroke, said at least one gripper assembly including lateral adjustment means for selectively positioning said gripper assembly along said forward edge and longitudinal adjustment means for selectively positioning said gripper assembly at said forward edge of said stock to accommodate variable arrangements of said forward edge.

15. The apparatus as defined in claim 14 wherein said carriage drive means includes independent control means for selectively varying said pick-up stroke and said drop-off stroke of said carriage member to selectively coordinate said take-off apparatus with said printing press.

16. The apparatus as defined in claim 14 wherein said gripper assembly includes gripper drive means operably engaged therewith and movable with said gripper assembly for actuating said gripper assembly at predetermined points during said pick-up stroke and said drop-off stroke to grip and release said stock, and said take-off frame includes trigger means mounted at a predetermined position thereon and operably communicating with said gripper drive means for actuating said gripper assembly to release said stock at a drop-off point as said carriage member passes through said drop-off stroke, said position of said trigger means being adjustable to vary said drop-off point of said stock.

17. The apparatus as defined in claim 14 which includes sensing means actuated by said carriage member in a rest position and operably communicating with said carriage drive means for triggering said carriage drive means to actuate said carriage member at a reduced gripping speed as said carriage member travels between said rest position and a pick-up point, at an increased drop-off speed as said carriage member travels through said drop-off stroke from said pick-up point to a drop-off point and at an increased pick-up speed as said carriage member travels through said pick-up stroke to said rest position.

18. A take-off apparatus for removing sheets of stock from a press bed of a screen printing press comprising:

a take-off frame adapted to be operated adjacent said printing press and including at least one guide rail;

a carriage assembly having a traverse member slidably mounted on said guide rail, said carriage assembly being reciprocal along said guide rail through a pick-up stroke and a drop-off stroke for transferring said stock from said press bed, carriage drive means operably connected to said carriage assembly for selectively actuating movement of said carriage assembly independently of said printing press, said carriage drive means including an independent pick-up speed control and an independent drop-off speed control for selectively varying said pick-up and said drop-off strokes of said carriage assembly to selectively coordinate said take-off apparatus with said printing press; and at least one gripper assembly mounted to said carriage assembly having gripper jaws for gripping a forward edge of said stock at a pick-up point as said carriage assembly travels through said pick-up stroke and for releasing said stock proximate to a drop-off point as said carriage assembly travels through said drop-off stroke, said at least one gripper assembly including gripper drive means operably engaged therewith for actuating said gripper jaws, a first adjustable clamping apparatus secured to said traverse member for selectively positioning said gripper jaws laterally along said forward edge and a second adjustable clamping apparatus secured to said first adjustable clamping apparatus for selectively positioning said gripper jaws longitudinally at said forward edge of said stock to accommodate variable arrangements of said stock.

19. The apparatus as defined in claim 18 which includes trigger means mounted at a predetermined position on said take-off frame and operably connected with said gripper drive means for actuating said gripper jaws to open and release said stock at said drop-off point, said position of said trigger means being adjustable to vary said drop-off point of said stock.

20. The apparatus as defined in claim 18 which includes sensing means actuated by said carriage member in a rest position and operably communicating with said carriage drive means for triggering said carriage drive means to actuate said carriage member at a reduced gripping speed as said carriage member travels between said rest position and said pick-up point, at an increased drop-off speed as said carriage member travels through said drop-off stroke from said pick-up point to said drop-off point and at an increased pick-up speed as said carriage member travels through said pick-up stroke to said rest position.

21. An apparatus for removing printed substrates from the bed of a screen printing press and including a carriage mounted for reciprocative movement relative to said bed, a gripper assembly adapted to be mounted on said carriage comprising:

mounting means for mounting said gripper assembly on said carriage including lateral adjustment means for selectively positioning said gripper jaws along a forward edge of said substrate and longitudinal adjustment means for selectively positioning said gripper assembly at said forward edge;

a gripper body attached to said mounting means;

a pair of jaws mounted to said gripper body and adapted to be selectively opened and closed; and gripper drive means operably engaged with said jaws for closing said jaws to grip said substrate at a pick-up point and for opening said jaws to release said substrate at a drop-off point.

22. The apparatus as defined in claim 21 wherein said lateral adjustment means comprise a first adjustable clamping apparatus for mounting said gripper assembly to said carriage and for selectively positioning said gripper assembly laterally, and said longitudinal adjustment means comprise a second adjustable clamping apparatus secured to said first adjustable clamping apparatus for selectively positioning said grippers longitudinally.

23. The apparatus as defined in claim 21 which includes a plurality of said gripper assemblies, each of said gripper assemblies being adjustable both laterally and longitudinally independently one from the other on said carriage.

24. The apparatus as defined in claim 21 wherein said gripper drive means include an adjustment mechanism for varying a gap between said jaws to accommodate varying thicknesses of said substrate.

* * * * *